US010472115B2

(12) United States Patent
Clarke

(10) Patent No.: US 10,472,115 B2
(45) Date of Patent: Nov. 12, 2019

(54) DISPENSER

(71) Applicant: Grip Systems Limited, Birmingham (GB)

(72) Inventor: Marcus Clarke, West Midlands (GB)

(73) Assignee: Grip Systems Limited, Birmingham (GB)

( * ) Notice: Subject to any disclaimer, the term of this patent is extended or adjusted under 35 U.S.C. 154(b) by 491 days.

(21) Appl. No.: 15/170,170

(22) Filed: Jun. 1, 2016

(65) Prior Publication Data

US 2016/0355293 A1 Dec. 8, 2016

(30) Foreign Application Priority Data

Jun. 1, 2015 (GB) ..... 1509391.7

(51) Int. Cl.
*B65B 67/08* (2006.01)
*B65B 59/04* (2006.01)
*B65H 23/06* (2006.01)

(52) U.S. Cl.
CPC ..... *B65B 67/085* (2013.01); *B65H 23/063* (2013.01)

(58) Field of Classification Search
CPC ..... B65B 67/085; B65B 23/063; B65B 59/04
See application file for complete search history.

(56) References Cited

U.S. PATENT DOCUMENTS 2,076,870 A * 4/1937 Taylor ..... B65H 75/30 242/610.4
4,102,513 A 7/1978 Guard
4,166,589 A 9/1979 Hoover et al.
4,714,211 A * 12/1987 Hwang ..... B65B 67/085 242/423.1
5,595,356 A * 1/1997 Kewin ..... B65H 75/187 242/611.2
5,711,142 A * 1/1998 Cromartie ..... B65H 54/553 242/129.51
5,779,179 A * 7/1998 Zentmyer ..... B65B 67/085 242/423.2
6,076,764 A * 6/2000 Robinson ..... B26D 7/24 242/571.5
6,883,298 B2 * 4/2005 Gooding ..... B65B 67/085 156/574

(Continued)

FOREIGN PATENT DOCUMENTS

CA 1177021 A 10/1984
DE 202009012702 U1 12/2009
EP 2135807 A1 12/2009

*Primary Examiner* — William A. Rivera
(74) *Attorney, Agent, or Firm* — Joseph C. Zucchero; Carolyn S. Elmore; Elmore Patent Law Group, P.C.

(57) ABSTRACT

A system for dispensing film wrap is disclosed, the system comprises a dispenser having a first connector portion and second connector portion spaced apart from the first connector portion. A roll of film wrap comprising a core having film wrap wound thereon is configured to extend between the first connector portion and the second connector portion. At least one end of the wall of the core and/or the edge of the film wrap is profiled and interlockable with a complimentary interlocking member located at the remote end of the first or second connector portion so as to prevent lateral movement of the film wrap with respect to the first and second connector portions of the dispenser. This beneficially reduces slippage of the film wrap when it is being used to wrap a load.

12 Claims, 6 Drawing Sheets

(56) References Cited

U.S. PATENT DOCUMENTS

| | | | | |
|---|---|---|---|---|
| 6,926,225 | B1 | 8/2005 | Powers | |
| 7,228,677 | B2 * | 6/2007 | Yu Chen | B65B 67/085 242/570 |
| 7,357,349 | B1 * | 4/2008 | Huang | B65B 67/085 242/405.3 |
| 7,604,195 | B1 * | 10/2009 | Lai | B65B 59/00 242/130.2 |
| 9,296,252 | B2 * | 3/2016 | Masecar | B65H 37/005 |
| 2003/0208994 | A1 | 11/2003 | Gooding et al. | |
| 2012/0031045 | A1 * | 2/2012 | Castro Rodriguez | B65B 67/085 53/389.3 |
| 2014/0116004 | A1 | 5/2014 | Pace | |

* cited by examiner

DISPENSER

RELATED APPLICATION

This application claims priority under 35 U.S.C. § 119 or 365 to Great Britain, Application No. GB1509391.7, filed Jun. 1, 2015. The entire teachings of the above application are incorporated herein by reference.

This invention relates to a dispenser, in particular a dispenser for dispensing stretch film to be applied to a load filled pallet.

The delivery of goods via the postal service or other delivery services is becoming ever more common, especially with the popularity of online shopping. Such businesses rely on efficient warehouse distribution practices due to the throughput of the goods required to meet the ever increasing number of orders. Further, the storage of stock and transportation of goods to shop floors must keep up with the demand of customers frequenting such shops.

Such commercial goods are transported on pallets or other similar storage containers and the items must be securely contained within an external packaging to unitise pallet loads and ensure the minimum damage of the items.

It is common to use a stretch film, or stretch wrap, which is a highly stretchable plastic film, to enclose goods whereby the elastic recovery of the film keeps the goods tightly bound ensuring improved strapping effect is applied to the products to be contained. The use of stretch film also offers more efficient handling and storage of unit loads, a degree of tamper resistance and can deter package pilferage. The film can also be considered to provide a degree of protection against dust, moisture and in some instances (depending on the material of the stretch wrap) sunlight.

It is also common to use such a stretch wrap product in airports whereby a person's suitcase is surrounded by stretch wrap to ensure the contents are protected therein.

Stretch wrap dispensers are known whereby the dispenser comprises a shaft for receiving and supporting the core of a roll of stretch wrap. The dispenser is designed to be held at the top and the side of the dispenser to enable the wrap to be applied to the desired items. The dispenser may further comprise a brake system for providing resistance so as to create stretch of the film. However, such dispensers are known to be cumbersome to use since the position of the hand grips are far from being ergonomically distributed. This results in a non-conventional hand position of the user causing them to bend over, which can lead to back or related injuries. Also, as a result of the hand grip configuration, the user may opt not to hold the dispenser via the hand grips, which may provide an uncomfortable user experience due to the user having to hold onto sharp metal edges or due to the dispenser slipping out of the user's hands. Currently available dispensers can also be considered bulky and when they are made from steel, which is the conventional material, the dispenser is heavy. In some instances, it is difficult and time consuming to refresh the dispenser with a refill.

To improve the time for removing a used roll of film it is known to use a dispenser having a first and second connector spaced apart, whereby the roll of stretch wrap is provided between the first and second connector. Whilst there may no longer be the requirement of removing the core of the stretch wrap from a shaft, such systems have been found to be cumbersome when inserting a replacement stretch wrap, and therefore refilling such dispensers is still considered to be time consuming. The roll of film is a standard product and the dispenser may not be optimised thereby allowing for slippage of the roll of film with respect to the dispenser as the film is applied to a load to be wrapped.

Therefore, in order to speed up the film application process, and to eliminate the loss of time in refilling the dispenser, it is known for the user to dispose of the dispenser entirely and to apply the film by hand. Whilst this is generally more efficient than using the current wrap dispensers, this provides little control in the stretch of the film and is hard on the hands since use in this way over prolonged periods can lead to sores or blisters. Further, applying the film in this way usually leads to an incorrect body position being adopted when wrapping the pallet, which again may lead to injury. This is especially the case when the stretch wrap is to be applied to the base region of the pallet.

Therefore, the present invention and its embodiments are intended to address at least some of the above described problems and desires. In particular, it enables the stretch wrap to be applied in an efficient and ergonomic manner, thereby encouraging a good working practice when applying the wrap to a pallet containing a load. This in addition to providing a secure non slip retention of the film, smooth consistent action of the film and optimised tension control of the film for the user is expected to reduce back and related injuries. Further, the improved mechanism for inserting and removing a roll of film contributes to the efficiency of wrapping the pallet and its load, whilst utilising the dispenser. Therefore, the invention provides an improved user experience whereby the dispenser aids the stretch wrapping process.

According to a first aspect of the invention there is provided a: system for dispensing film wrap, the apparatus comprising:

a dispenser having a first connector portion and second connector portion spaced apart from the first connector portion; and a roll of film wrap comprising a core having film wrap wound thereon, the roll of film wrap being configured to extend between the first connector portion and the second connector portion, wherein at least one end of the wall of the core and or the edge of the film wrap is profiled and interlockable with a complimentary interlocking means located at the remote end of the first or second connector portion so as to prevent lateral movement of the film wrap with respect to the first and second connector portions of the dispenser.

The core may be tubular.

The dispenser may comprise a main body having a first and second end;

the first connector portion being configured proximate to the first end of the main body; and the second connector portion being configured at the second end of the main body, the first and second connector portions being spaced apart from each other along a common axis, wherein the film wrap is arranged between the first connector portion and the second connector portion along the common axis.

At least part of the profiled end of the wall of the core of the edge of the film wrap may define the female part of an interlockable arrangement and the interlocking member of the first and/or second connector portion may define the male part of an interlockable arrangement whereby the first part and the second part are couplable.

At least part of the profiled edge of the wall of the core and/or the film wrap may be provided by a notch located at an end of the core and/or the edge of the film wrap wound around the core.

The notch may be a cutaway portion provided in a wall of the core of the film wrap.

The notch may extend from an edge of the core to a position spaced apart from the edge of the core such that the notch extends substantially parallel to the longitudinal axis of the core.

There may be provided a first notch and a second notch positioned diametrically opposed to each other.

The complimentary interlocking member on the first and/or second connector may be a protrusion receivable within the notch.

The interlocking member comprises a first disc portion having a tubular hub extending outwardly at its centre. A first protrusion extends radially from the hub in a first direction and a second protrusion extends radially from the hub in a second direction opposing the first direction. As a result, the first and second projection may be diametrically opposed.

The first and second protrusion may be an elongate protrusion defining a paddle type arrangement.

The first or second connector portion may comprise a film wrap tension controller.

A tension controller may terminate the upper end of the first or second connector portion.

The tension controller may comprise an adjustable portion that may be rotatable and in mechanical communication with a moveable part configured intermediate to the actuator and an end of the roll of film so as to provide tension control of the film.

The adjustable portion may be a rotatable knob and the moveable part is a bolt having a clamping mechanism.

The clamping mechanism may comprise a nut having a first and second part configurable between a first configuration wherein the first and second part are arranged in contact with each other enabling movement of the nut along the thread of the bolt in a first direction and a second configuration wherein the first and second part of the nut are spaced apart so as to provide a freewheeling state which prohibits movement of the nut along the longitudinal axis of the bolt.

The system may comprise a quick release mechanism for configuring the clamping mechanism between a freewheeling state and a moveable state.

The system may comprise an actuator for actuating the moveable state of the clamping mechanism.

The actuator may be configured to terminate the first end of the main body.

The actuator may be a push button switch.

The actuator may be in mechanical communication with the clamping mechanism.

The system may comprise a biasing member in mechanical communication with the clamping mechanism and for enabling relative movement between the nut and the thread on actuation of the actuator.

The biasing member may be configured to bias the nut such that it moves in the second direction opposing the first direction.

The biasing member may be a spring.

The system may comprise a braking mechanism located at the first connector portion and configured to prevent rotational movement of the core of the film when the brake is applied.

The braking mechanism may comprise a rubberised material located at the base of the first connector portion.

The first connector portion may be terminated by a first interlocking member and the second connector portion may be terminated by a second interlocking member. The first profiled edge may be identical to the second profiled edge.

The first profiled edge of the first connector portion may be interlockable with a profiled edge at one end of the wall of the roll of film and the second profiled edge of the second connector portion may be interlockable with the profiled edge at the other end of the wall of the roll of film so as to prevent relative lateral movement between the dispenser and the roll of film.

The main body may comprise a first and second curved portion with a straight portion positioned there-between.

The system may further comprise a first handle located on at least one of the curved portions.

The handle may be located on the curved portion located above the straight portion.

The system may comprise a second handle positioned on the straight portion.

The second handle may be positioned at the base of the straight portion.

The first and/or second handle may be made from rubber enabling a user to grip the system securely.

The dispenser may comprise a base foot connected to a base region of the first or second connector portion.

At least part of the base foot may have a curved edge.

The profiled end may be provided by a protrusion extending from a side edge of the core of the film wrap.

The complimentary interlocking profile on the first and/or second connector may be a recess for receiving the protrusion.

In a further aspect of the invention there is provided a dispenser for use in the above-mentioned system:

a main body having a first and second end, a first connector portion configured proximate to the first end of the main body;

a second connector portion configured at the second end of the main body, the first and second connector portions being spaced apart from each other along a common axis;

wherein at least the first connector portion is terminated by a first interlocking means configurable to, in use, cooperate with a corresponding profiled edge located in the wall of the core and/or an edge of the film wrap wound around the core of a roll of film wrap to be fixedly arranged between the first connector portion and the second connector portion along the common axis so as to prevent relative lateral movement between the roll of film and the dispenser.

The dispenser may further comprise a control unit configured to jointly apply tension to the roll of film in a first state and to provide quick release of the film from the dispenser in a second state.

The control unit may comprise a bolt with a clamping mechanism.

The clamping mechanism may comprise a nut having a first and second part configurable between a first configuration wherein the first and second part are arranged in contact with each other enabling movement of the nut along the thread of the bolt in a first direction and a second configuration wherein the first and second part of the nut are spaced apart so as to provide a freewheeling state which prohibits movement of the nut along the longitudinal axis of the bolt.

The dispenser may further comprise a biasing member in mechanical communication with the clamping mechanism and for enabling relative movement between the nut and the bolt when the nut is in the first configuration.

The second connector portion may be terminated by a second interlocking means configurable to, in use, cooperate with a corresponding profiled edge located at an end of a core of a roll of film wrap to be fixedly arranged between the first connector portion and the second connector portion along the common axis.

In a further aspect of the invention there is provided a roll of film wrap for use in the above-mentioned system comprising:

a main core having a first and second end, and a length of film wrap configured to be wrapped around the core such that in use the film wrap is removable from said core, wherein the wall of the core and/or an edge of the film wrap wound around the core comprises at least one profiled edge;

the profile being shaped and configured such that in use the profiled edge is receivable and interlockable in a co-operable end of the dispenser so as to prevent relative lateral movement between the roll of film and the dispenser.

The profiled edge may be provided at each end of the core.

The profiled edge may comprise a notch.

The notch may comprise a cutaway portion located in the core or the edge of the film wrapped about the core.

BRIEF DESCRIPTION OF THE DRAWINGS

Whilst the invention has been described above it extends to any inventive combination of the features set out above, or in the following description, drawings or claims. For example, any features described in relation to any one aspect of the invention is understood to be disclosed also in relation to any other aspect of the invention.

The invention will now be described, by way of example only, with reference to the accompanying drawings, in which.

Figure 1:
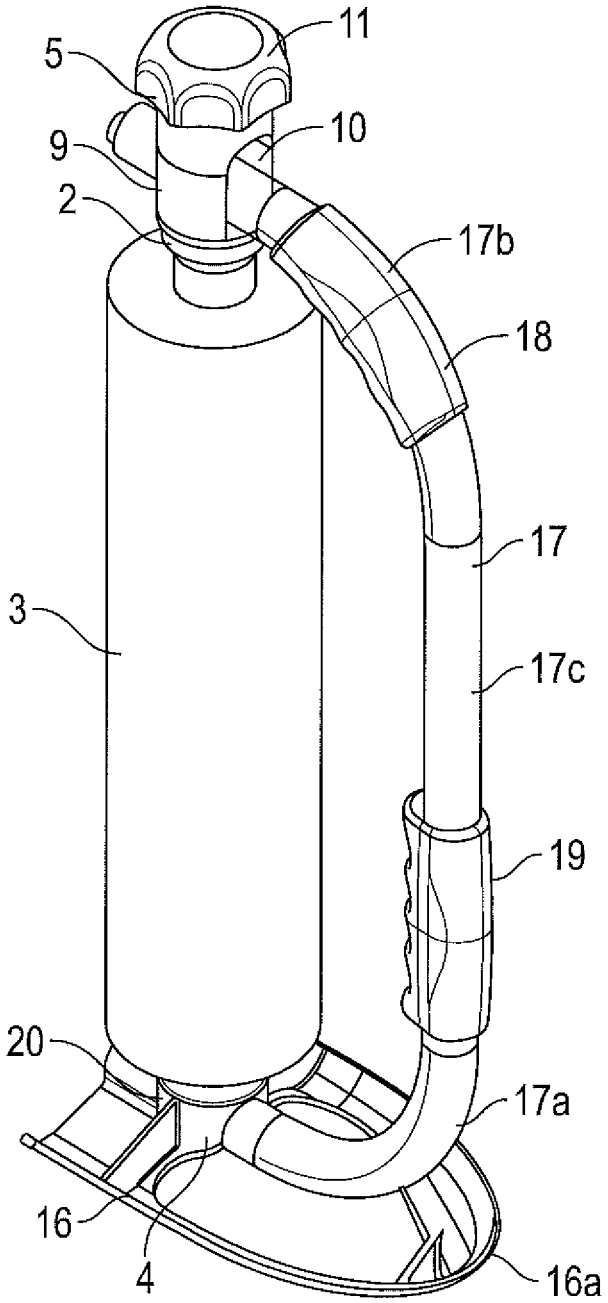
FIG. 1 is a perspective view of the dispenser according to an aspect of the invention.

Referring firstly to FIG. 1, there is shown a system for dispensing film wrap. The system comprises a dispenser having a first connector portion 1 and second connector portion 2 spaced apart from the first connector portion 1. A roll of film wrap comprising a core 3 having film wrap wound thereon is configured to extend between the first connector 1 portion and the second connector portion 2 of the dispenser. At least one end wall of the core of the film wrap is profiled and interlockable with a complimentary interlocking means located at the remote end of the first connector portion 1 so as to prevent lateral movement of the film wrap and to prevent the core from slipping with respect to the dispenser. The first and second connector portions, 1 and 2, are rotatable to permit rotation of the film wrap. The dispenser is therefore not to be used with a standard roll of film supplied in the industry since this standard roll of film is prevented from being installed by the complimentary interlocking means provided on the first connector portion.

The dispenser comprises a main body, at least part of which follows an arcuate path. The main body has a first end 4 and second end 5. The first connector portion 1 is configured proximate to the first end 4 of the main body. The first end 4 is positioned below the second end 5 in normal working use and when in the usual stored position. Therefore, the first connector portion 1 is located at the base of the dispenser.

The second connector portion 2 is configured at the second end 5 of the main body, which is considered to be the top region. The first and second connector portions, 1 and 2, which effectively act as spigots, are spaced apart from each other along a common axis such that the remote ends of the connector portions are configured to face each other. The distance between the first and second connector portion may, for example, be between 350 mm to 650 mm, say between 400 and 500 mm in one specific exemplary embodiment, but the present invention is in no way intended to be limited in this regard.

Figure 5:
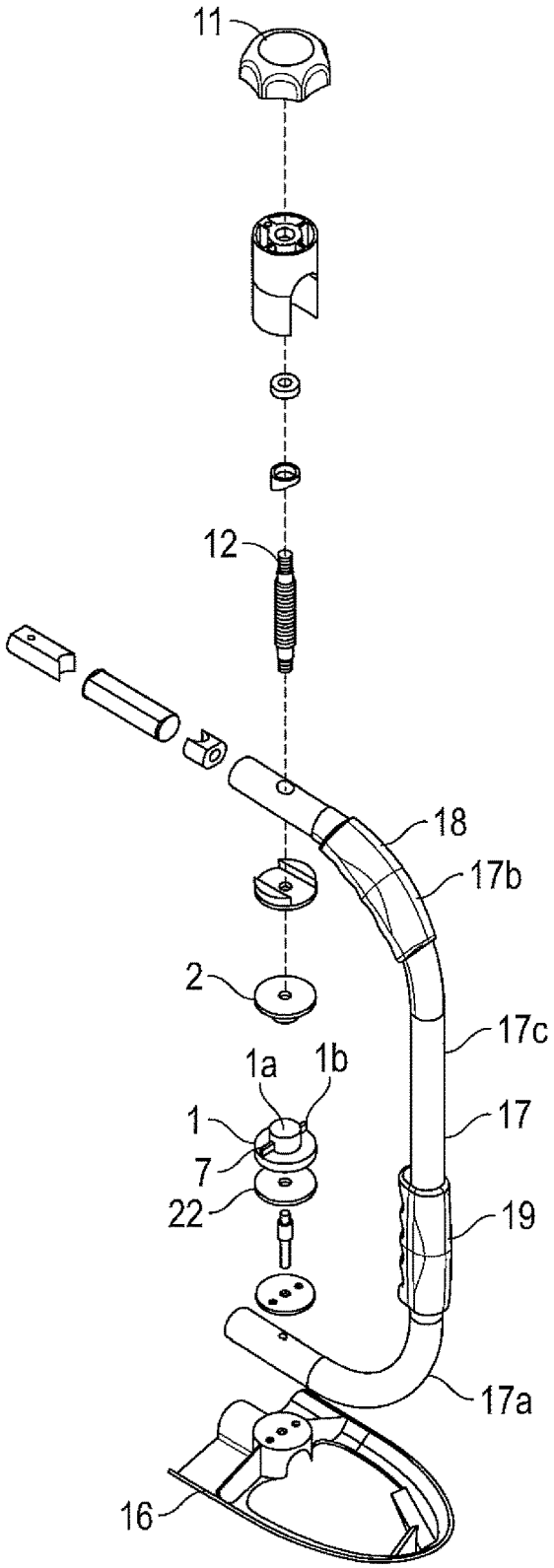
FIG. 5 is an exploded perspective view of the dispenser of FIG. 1.

Referring to FIG. 5 of the drawings, at least part of the profiled end of the film wrap defines the female part (not shown) of an interlockable arrangement and the interlocking means of the first connector portion 1 defines the male part 7 of the interlockable arrangement whereby the female part (not shown) and the male part 7 are couplable.

Figure 2:
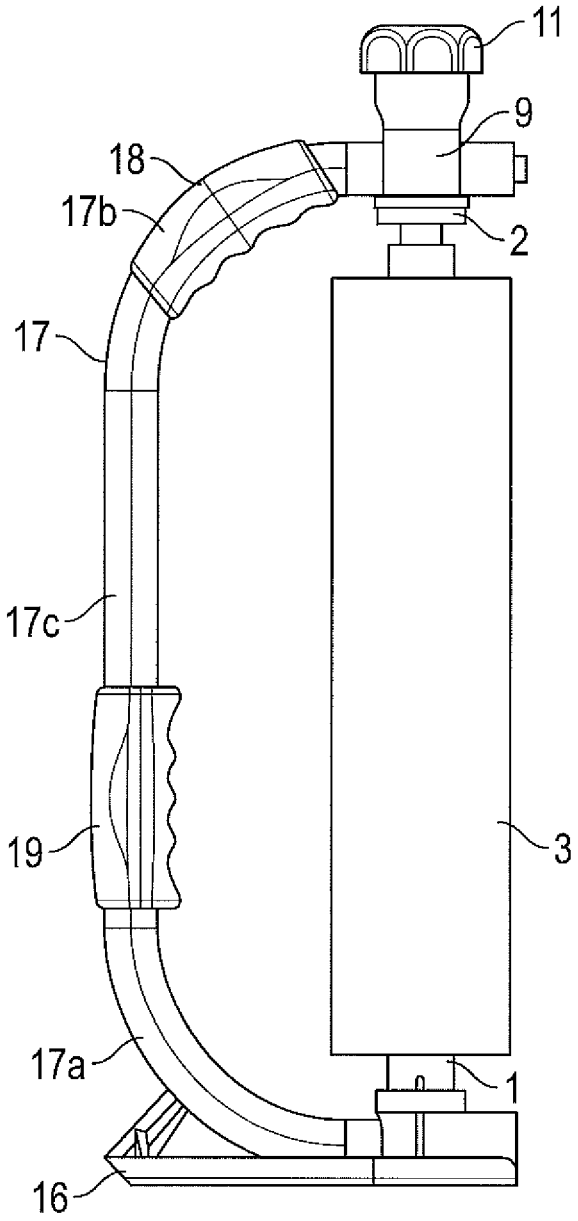
FIG. 2 is a side view of the dispenser of FIG. 1.
Figure 3:
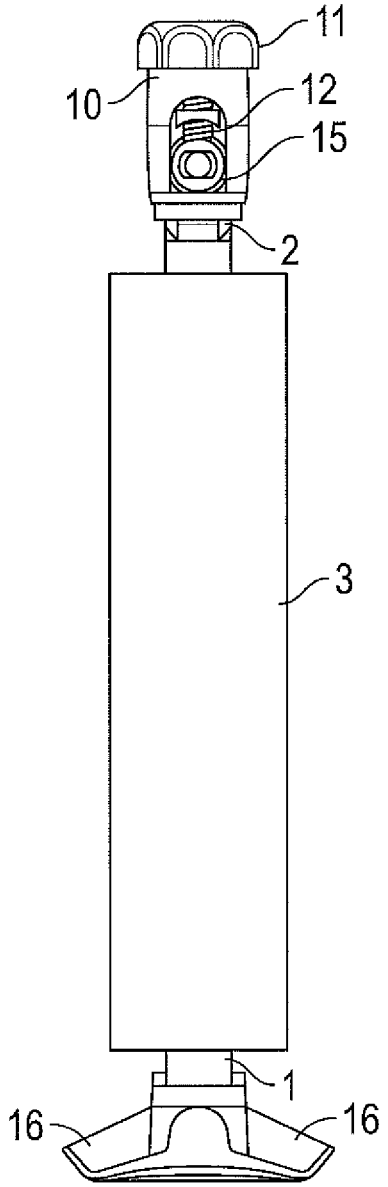
FIG. 3 is a front view of the dispenser of FIG. 1.
Figure 4:
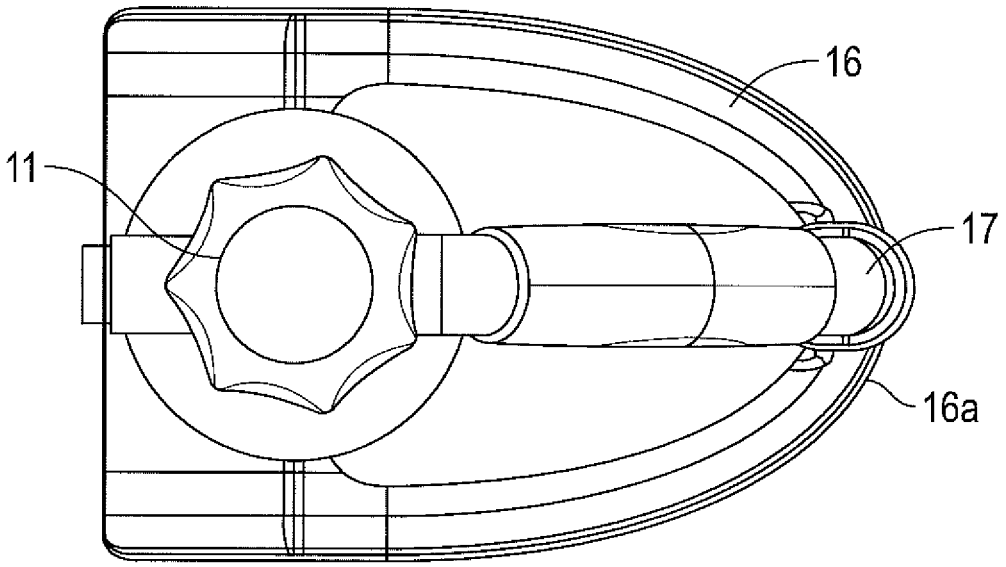
FIG. 4 is a top view of the dispenser of FIG. 1.

The profiled end comprises an interrupted circumferential edge, wherein the interrupted circumferential edge of the core defines a stepped profile. Therefore, the profiled end is not merely linear as per standard rolls of film wrap that are supplied. The profiled edge of the film wrap core is provided by a notch or recess (as shown in FIG. 2) located in the wall of the core and is located at an end of the core 3 and/or the edge of the film wrap supported by the core 3. The recess or notch (not shown) is, for example, a cutaway portion provided in a wall of the core 3 of the film wrap. The core 3 of the roll is open-ended, i.e. the core 3 is tubular in form. The notch is located in the wall of the tube and is separate and distinct from the opening of the tube.

The first and second notch (as shown in FIG. 2 in part) comprises a first cutaway portion of the wall and a second cutaway portion of the wall positioned diametrically opposed to the first cutaway portion. The cutaway portion or notch extends from the side edge of the core to a position spaced apart from the edge of the core such that the notch extends parallel with respect to the longitudinal axis of the core.

Regardless of the form of the recess or notch (not shown), the complimentary interlocking means on the first connector 1 is a protrusion 7 shaped to be receivable within the recess or notch (not shown). FIG. 2 shows the first connector portion to be formed of a base plate having a raised hub portion that is insertable into the opening of the tube of the core and from which extend the first and second paddle like protrusions that extend from the cylindrical hub to the edge of the base plate. The base plate is a circular disc like structure. Therefore, a roll of film having a core with a flat edge is not capable of forming a seamless interface with the first connector since the paddle like protrusion of the first connector prevents contact of the edge of the core with the base plate of the first connector portion.

The second connector portion 2 is terminated by a central cylinder portion which is receivable within the interior of the core so as to interlock the top edge of the second end of the core with the second connector portion so as to fixedly arrange a roll of film wrap between the first connector portion 1 and the second connector portion 2 along the common axis.

The first interlocking means is the protrusion 7 which is configured to, in use, to be received by the notch (not shown) positioned at a co-operable end of the core of the roll of film wrap so as to effect an interlocked state between the co-operable end of the core 3 and the first connector portion 1. The first and second end of the protrusion 7 are receivable within a first and second diametrically opposed cutaway portion (not shown) located at the edge of the core of the roll of film wrap respectively. Therefore, to ensure the required interlocked state, the recess is shaped and configured to snugly receive the protrusion 7. It can be appreciated that a locked state is achieved by the end of the roll and the end of the connector portion rather than merely a friction fit. As a result, the notched core interfaces seamlessly with the first connector portion of the dispenser.

Referring to FIG. 5 of the drawings, the first connector portion 1 is positioned proximate to the first end of the main body and is a substantially cylindrical portion having an aperture 1*a* extending there-through. At least part of the main body is configured to pass through the aperture 1*a* of the first connector. This ensures that the main body is connected to the first connector and that the actuator 14, which is positioned on the first end of the main body is easily accessible for the user.

Figure 6B:
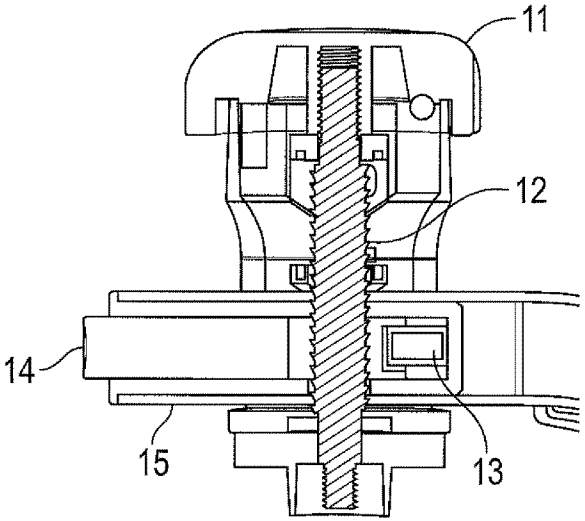
FIG. 6*b* is a front cross-sectional view of the quick release tension controller mechanism used in the dispenser of FIG. 1, when in the unlocked configuration.
Figure 6C:
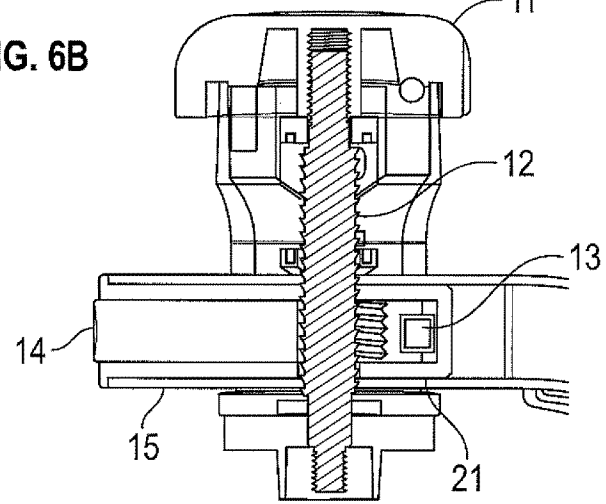
FIG. 6*c* is a front cross-sectional view of the quick release tension controller mechanism used in the dispenser of FIG. 1, when in the locked configuration.
Figure 6A:
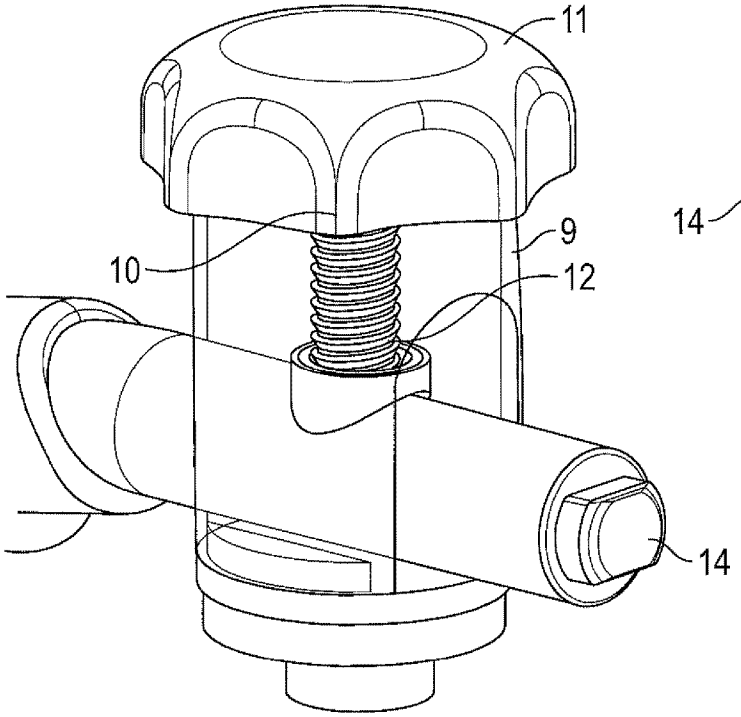
FIG. 6*a* is a perspective view of the quick release tension controller mechanism used in the dispenser of FIG. 1.

Referring to FIG. 6*a* of the drawings, the dispenser comprises a single control unit 9 providing quick release and tension control.

A tension controller 10 terminates the upper end of the substantially cylindrical portion of the second connector portion 2. The tension controller 10 adjusts the speed and degree of rotation of the roll of film so as to apply the required level of tension to the film enabling the film to be stretched. For example, to ensure the contents of the pallet are tightly wrapped, the tension is increased to minimise or even prevent rotation of the roll of film. The tension controller comprises a rotatable knob 11 which is in mechanical communication with a bolt 12 having a one-way thread and clamping mechanism located on the bolt 12.

Referring to FIG. 5 of the drawings, to enable the adjustable tension gain, a piece of rubberised material 22 is provided at the base of the first connector portion 1. As the knob 11 is rotated the remote end of the bolt 12 provides a pressure on the top of the roll of film via the second or upper connector portion 2. This ultimately brings the end of the thread into contact with the top end of the roll of film. This pressure is transferred down to the first or base connector portion 1. This effectively squeezes the roll between the first and second connector portion. As more pressure is applied on further actuation of the knob 11, the rubberised composite material located at the base of the second connector portion 2 acts as a brake. The knob 11 and composite material arrangement can be operated between a first configuration, as shown in FIG. 6*b*, allowing free rotation of the roll of film located on the dispenser and a second configuration, as shown in FIG. 6*c*, whereby the roll of film is prevented from rotating. Different tension points are provided as the knob 11 is configured between the first and second configuration. Due to the squeezing effect, when one end of the roll of film is prevented from moving, so to is the other end of the roll of film.

Referring to FIGS. 6*a*, 6*b* and 6*c* of the drawings, the bolt 12 is applied with a moveable carriage 21, for example a nut 21 that is rotatable about the thread so as to cause movement along the longitudinal axis of the bolt 12. The nut 21 also provides a clamping mechanism enabling a stop effect since it is split into two parts that, when the two parts are pulled apart, cause freewheeling of the nut on the thread of the bolt. The knob 11 causes helical movement of the carriage along the longitudinal axis of the bolt 12 in the first and second direction, depending on the direction of rotation of the knob 11. This helical movement only occurs when the first and second part of the nut 21 are brought together. Movement of the nut 21 along the longitudinal axis of the bolt 12 corresponds to different tension states of the roll.

To provide the quick release effect, the clamping mechanism is spring loaded such that when the nut 21 is removed from the freewheeling state it is biased to return to its starting position whereby the tension applied to the roll is at a minimum.

Therefore, a biasing member 13, for example, a spring, is configured such that when the button 14 is depressed and the carriage is released from the stop position (caused by the freewheeling of the nut), and the biasing member 13 causes movement of the carriage in the second longitudinal direction to release the tension applied to the top of the roll and to enable the removal or insertion of the roll of film as desired i.e. to enable the profiled end 6 at the base of the roll to be removed from the interlocking means of the lower connector portion 1. This provides a rapid roll change system.

An actuator is configured on the end of the first end of the main body for actuating the quick release state whereby the actuator is in the form of a press button 14. The press button 14 is the external face of a spring loaded split pin 15 which is in mechanical communication with a biasing member 13, for example, a spring, on its internal face 15*a*. Depression of the press button 14 forces the pin 15 to slide horizontally relative to the bolt 12, compressing the spring 13, and disconnecting the two parts of the nut 21, thereby opening the pin 14. This activates the quick release mechanism, enabling the bolt 12 to slide rapidly vertically relative to the female part, thereby relieving the tension on top of the roll or film and allowing for the removal of insertion of a roll or film. Release of pressure from the actuating button 14 disables the quick release mechanism by enabling the spring 13 to extend, pushing the pin 14 part back into its natural, closed confirmation which causes the two parts of the nut 21 to be reunited and enables movement of the nut along the bolt under the control of the spring.

Therefore, a quick release mechanism is provided with the depression of a single button 14 which enables the release of the roll of film or the core 3 of the roll once the film has been depleted. Similarly, on loading the film, the complete spring loaded mechanism is depressed in a single action to enable the ends locate the film.

Once the roll of film is located in the desired position the user can push down on the twist lock knob and the roll is secured into position. Therefore, the roll is installed by a simple push fit action which is extremely efficient to apply.

Referring to FIGS. 1, 2 and 5 of the drawings, the first connector portion 1 terminates a first end of the main body. This end can be considered to be the base 16 or lower end of the main body when in normal use or in a stored state.

The main portion 17 comprises a first 17*a* and second 17*b* curved portion with a straight portion 17*c* positioned therebetween. A first handle 18 is located on at least one of the curved portions, for example the curved portion 17*b* located above the straight portion. A second handle 19 is also positioned on the straight portion 17*c*, for example the second handle is located at the base of the straight portion 17*c*.

The first 18 and/or second 19 handle is made from rubber to provide an improved grip of a user. The handle is also shaped to enable the moulding of the handle to a person's hand in an ergonomic manner.

The dispenser comprises a base foot 16 connected at one end to the base region 20 of the second connector portion 2. The other end of the base foot 16 is connected to the lower curved region 17*a* of the main body, i.e. below the second handle. The base foot 16 acts as a stand when the dispenser is to be stored to one side or when the user has a break in applying the stretch wrap. At least part of the base foot 16 has a curved edge 16*a* enabling the stand to act as a guide as the curved edge 16*a* is dragged or skidded along the floor when the lower part of the load is wrapped with the film. Therefore, some of the weight of the dispenser is transferred to the floor, further reducing the weight of the dispenser when applied at this awkward height. This further minimises the impact on a person's back or related joints. The ergonomic arrangement of the stand also ensures that the film is applied at the right distance from the floor ensuring optimal wrapping of the lower region of the load. This minimises the wastage of the stretch wrap at this region.

The dispenser and the roll of film combined form a system for applying the film to the exterior of a load bearing pallet. As described above, the first interlocking part (not shown) on the first connector portion 1 and the corresponding profiled wall (located at the end of the core of the roll of film) are removeably couplable.

The dispenser is configured to be used with a non-standard roll of film that comprises a main core 3 having a first and second end, and a length of film wrap configured to be wrapped around the core such that in use the film wrap is removable or unwrappable from said core 3. The wall of the core 3 and/or edge of the film wrap supported by the core 3 has at least one profiled end or edge 6. The profiled end 6 is shaped and configured such that in use the profiled end 6 is co-operable with an interlocking means located at an end of the dispenser portion so as to prevent relative lateral movement between the roll of film and the dispenser when they are interconnected.

Whilst only one end of the core 3 requires a notch 6 to be applied such that it cooperates with the first or lower connector of the dispenser, the core 3 of the roll of film is provided with a notch in either end such that the roll of film can be applied in the dispenser either way up so as to be operated in a clockwise or counter-clockwise direction as necessary.

The core 3 of the film wrap may, for example, have a diameter of 25 mm and comprises a notch or recess in the side wall of the core 3 at the end.

The dispenser is formed of aluminium and plastic, however other light weight yet impact resistant materials may be applied, for example a suitable composite material such a fibreglass.

The core 3 of the film may be made from any suitable material, such as cardboard or plastic and the stretch wrap or film itself may be made from a plastic for example PVC or linear low-density polyethylene LDPE.

Various modifications to the principles described above would suggest themselves to the skilled person. For example, the cross section of the notch and the co-operable projection need not be rectangular, and may have an alternative cross-sectional shape, for example circular or triangular.

There may be more than two protrusions provided on the first connector, but this would require the end of the core to have the corresponding number of notches to ensure a seamless interface occurs between the two.

The first and second interlocking means of respective connectors of the dispenser need not be identical and instead the first connector may comprise a notch and the second connector may comprise a protrusion.

The interlocking mechanism may be provided at both ends of the film wrap and the dispenser.

The core of the film may have a protrusion at its end that is co-operable with a recess located at the corresponding connection member of the dispenser.

In an alternative embodiment of the invention, referring to FIG. 1 of the drawings, when the core 3 of the roll of film is positioned between the first and second connector portions, 1 and 2, along the common axis it is retained in position by a retractable protrusion (not shown) of the connector portion of the dispenser is received within the corresponding recess of the core 3. Therefore, to fit or remove the roll of film the remote end of the protrusion (not shown) is moved between a first position whereby the protrusion extends from the remote end of the first connector 1 to a second position where the distance between the remote end of the protrusion (not shown) and the remote end of the first connector 1 is reduced, for example such that the remote end of the protrusion (not shown) is made to be level with the remote end of the first connector portion 1 so as to enable the insertion or removal of the roll of film. On insertion of the roll of film, once the roll is provided along the common axis such that the ends of the core 3 are arranged between the first and second connector, the protrusion (not shown) is returned to its fully extended state.

The protrusions may be retractable pins and the core may be provided with corresponding apertures located within the wall of the tube and spaced apart from the edge of the tubular core. To apply the core, the pins are retracted and are returned to the extended state once the retracted pins are aligned with the apertures in the core.

An actuator is configured on the end of the first end of the main body for actuating the retractable protrusion i.e. for enabling movement of the protrusion between the first extended state and the second retracted state. The actuator is in the form of a press button.

The press button is in mechanical communication with a biasing member, for example, a spring, such that when the button is in the 'unpressed' state the bias member ensures that the protrusion is positioned in the extended state i.e. such that it extends from the first connection portion. Once the button is pressed, the protrusion is retracted to enable the insertion or removal of the roll of film as desired. Therefore, a quick release mechanism is provided with the depression of a single button which enables the release of the roll of film or the core of the roll once the film has been depleted. Similarly, on loading the film, the complete spring loaded mechanism is depressed in a single action to locate the film.

In an alternative embodiment, the carriage is configured to remain in discrete positions due to the presence of predetermined stop regions disposed along the thread. Therefore, the tension is ultimately applied to the roll of film by turning a ratcheted thread onto the end of the film core. This enables the carriage to be moved in a first longitudinal direction only and prevents movement of the carriage in a second longitudinal direction opposing the first longitudinal direction by means of a series of stop members.

Alternatively, the ends of the core 3 of the film wrap may be sealed and the recess (not shown) may be provided as an indent located in the sealed end.

It will be apparent to a person skilled in the art, from the foregoing description, that modifications and variations can be made to the described embodiments without departing from the scope of the invention as defined by the appended claims.

The invention claimed is:

1. A system for dispensing film wrap, the system comprising:

a dispenser having a first connector portion and a second connector portion the first and second connector portions being spaced apart from each other along a common axis; and a roll of film wrap comprising a core having film wrap wound thereon, the roll of film wrap being configured to extend along said common axis between the first connector portion and the second connector portion, wherein at least one end of the wall of the core and/or the edge of the film wrap is profiled and interlockable with a complimentary interlocking member located at the remote end of the first or second connector portion so as to prevent lateral movement of the film wrap with respect to the first and second connector portions of the dispenser; characterized in that the system further comprises a braking mechanism located at the first connector portion, and a tension controller terminating an end of the second connector portion, the tension controller comprising an adjustable portion that is rotatable and in mechanical communication with a movable part located intermediate the tension controller and an end of the roll of film wrap, wherein rotation of the adjustable portion causes linear movement of the movable part along said common axis toward said first connector portion between a first configuration, permitting free rotation of the roll of film wrap, and a second configuration in which said roll of film wrap is prevented from rotating, through a plurality of intermediate positions between said first and second configurations in which said movable part is in contact with said end of said roll of film wrap, and applies pressure thereto which is transferred to the braking mechanism so as to apply tension to said roll of film wrap by squeezing the roll of film wrap between said first and second connector portions, and wherein the tension state of the roll of film wrap defined by the respective intermediate position of said movable part.

2. A system according to claim 1, wherein the dispenser comprises a main body having a first and second end;

the first connector portion being configured proximate to the first end of the main body; and the second connector portion being configured at the second end of the main body.

3. A system according to claim 2, wherein the main body comprises a first and second curved portion with a straight portion positioned there-between.

4. A system according to claim 1, wherein at least part of the profiled end of the wall of the core defines the female part of an interlockable arrangement and the interlocking member of the first and/or second connector portion defines the male part of an interlockable arrangement whereby the first part and the second part are couplable.

5. A system according to claim 1, wherein the interlocking member comprises a first disc portion, a tubular hub located at the centre of the first disc portion and a first protrusion extending from the hub in a first direction and a second protrusion extending from the hub in a second direction, the first and second projections being diametrically opposed.

6. A system according to claim 1, wherein the first or second connector portion comprises a film wrap tension controller.

7. A system according to claim 6, wherein the tension controller comprises an adjustable portion that is rotatable and in mechanical communication with a moveable part configured intermediate to the tension controller and an end of the roll of film so as to provide tension control of the film.

8. A system according to claim 7, wherein the adjustable portion is a rotatable knob and the moveable part is a bolt having a clamping mechanism.

9. A system according to claim 8, further comprising a biasing member in mechanical communication with the clamping mechanism and for enabling relative movement between the nut and the thread on actuation of the actuator.

10. A system according to claim 1, further comprising a braking mechanism located at the first connector portion and configured to prevent rotational movement of the core of the film when the brake is applied.

11. A system according to claim 1, wherein the first connector portion is terminated by a first interlocking member and the second connector portion is terminated by a second interlocking member.

12. A system according to claim 1, wherein the dispenser comprises a base foot connected to a base region of the first or second connector portion.

* * * * *